United States Patent [19]

Hashimoto et al.

[11] Patent Number: 4,926,216

[45] Date of Patent: May 15, 1990

[54] FEEDER OF SHEET-LIKE PHOTO-SENSITIVE MATERIAL

[75] Inventors: Yasushi Hashimoto; Yasuyuki Tsuji; Akira Terakado, all of Ibaraki, Japan

[73] Assignee: Hitachi Koki Company, Tokyo, Japan

[21] Appl. No.: 325,587

[22] Filed: Mar. 20, 1989

[30] Foreign Application Priority Data

Mar. 18, 1988 [JP] Japan ..... 63-66045

[51] Int. Cl.[5] ..... G03G 15/00

[52] U.S. Cl. ..... 355/212; 242/67.3 R; 355/77; 355/309

[58] Field of Search ..... 355/211, 212, 77, 308, 355/309; 242/55.2, 67.3 R

[56] References Cited

U.S. PATENT DOCUMENTS 3,903,795 9/1975 Suzuki ..... 355/211
4,179,211 12/1979 Kimura et al. ..... 355/211
4,183,652 1/1980 Yanagawa ..... 355/211
4,316,759 2/1982 Becker et al. ..... 242/67.3

*Primary Examiner*—R. L. Moses
*Attorney, Agent, or Firm*—Cushman, Darby & Cushman

[57] ABSTRACT

A feeder for a electrophotographic printer to feed photo-sensitive paper onto the drum of the printer. Sheets of photo-sensitive paper are adhered to release paper. The sheets are separated from the release paper by rolling the sheets adhered to the release paper over a positioning roll, where separation occurs, and rolling the photo-sensitive sheets onto the drum and the release paper onto a take-up roll. The sheets are clamped at their front end to the drum the drum is rotated and the sheets are clamped at their rear end to the drum. The take-up roll is rotated by the driving force of a stepping motor and the frequency of the driving force is controlled to coincide with the rotational speed of the drum.

23 Claims, 3 Drawing Sheets

FEEDER OF SHEET-LIKE PHOTO-SENSITIVE MATERIAL

BACKGROUND OF THE INVENTION

The present invention relates to a feeder of sheet-like photo-sensitive materials to a drum in an electrophotographic printer. The feeding process is performed by winding the sheet-like photo-sensitive materials on the drum material surface and rotating the thus arranged drum.

In a conventional construction as shown in FIG. 5, after discharging the photosensitive material 7, which is no longer useable, from the peripheral surface of the drum I, the drum 1 is stopped. After opening a front end clamp 2 and making a clamping preparation, the unused photo-sensitive material 7 is fed out by means of the roller 6 from the tray 5 along the guide 4 to the front end clamp 2. After the front end of the photo-sensitive material 7 has been clamped by front end clamp 2, the drum 1 is rotated counterclockwise by an unillustrated drum driving means thereby winding the material 7 thereon. Subsequently, the drum 1 is stopped to clamp the rear end of the material 7, at which time the rear end clamp 3 clamps the rear end of the material 7.

In the prior art device depicted in FIG. 5, there exists a high probability that a sheet of the sheet-like photo-sensitive material 7 will be superposed on another sheet or obliquely transferred when being fed from the tray 5. This causes an error in the winding process. In addition a sheet of the photosensitive material fed out for winding which is brought into slide-contact with another sheet of photo-sensitive material stored in the tray 5 will probably be damaged. This leads to a decline in the quality of printed materials. Because the photo-sensitive material 7 assumes a tabular configuration a relatively large space is required for accommodating the tray 5, resulting in an increase in size. Furthermore, it is inconvenient to have the sheet-like photosensitive materials sit around when loading the photo-sensitive materials.

FIG. 6 shows a rolled photo-sensitive material in association with another conventional technique which solves the following problems inherent in the prior art of FIG. 5: (1) the photo-sensitive materials are superposed on each other and obliquely transferred; (2) damage is caused to the surfaces of the materials; (3) a relatively large space is needed for accommodation; and (4) it is inconvenient to have the photosensitive materials sit around. When winding the photosensitive materials on the drum by the conventional technique depicted in FIG. 6, there is an added step of cutting the rolled photosensitive material 7 to a required length with the cutter 9 prior to the step of clamping the rear end thereof by the conventional technique shown in FIG. 5.

Although the conventional technique of FIG. 6 is capable of eliminating the defects incidental to the prior art shown in FIG. 5, it involves the use of the cutter 9 for cutting the rolled photo-sensitive material to the required length. This arrangement increases the production costs of the feeder. Organic photosensitive material well known as an inexpensive material to form photo-sensitive sheets 7 tends to invariably cause deterioration in some portions when forming this material into a lengthy sheet. In the rolled photo-sensitive material, it is impossible to remove the deteriorated portions by cutting them off, and such portions are wound on the drum, thereby causing a decline in quality of the printed material. When obtaining the printed materials with no deteriorated portion, there must be a limit to the length of a sheet. In addition, the yield is also decreased.

SUMMARY OF THE INVENTION

Accordingly, it is an object of the present invention to provide a mechanism for feeding sheet-like photo-sensitive material of good quality in a sheet by sheet fashion to a drum which has a simple constitution and does not damage the surfaces of the sheet-like photosensitive material.

In accordance with the present invention sheet-like photo-sensitive material each cut to a necessary length are stuck to release paper and are then formed to assume a rolled configuration. The photo-sensitive material can therefore be fed out sheet by sheet together with the release paper without causing any damage as the outer peripheral end thereof is pulled up and released therefrom. The outer peripheral end of the previously rolled release paper is seized by another roll, and the sheetlike photo-sensitive material can be fed sheet by sheet to a drum by taking up the release paper while rotating the roll. The roll catches the outer peripheral end of the release paper when feeding the sheet-like photosensitive materials onto the drum.

DETAILED DESCRIPTION OF THE PREFERRED EMBODIMENT

Figure 1:
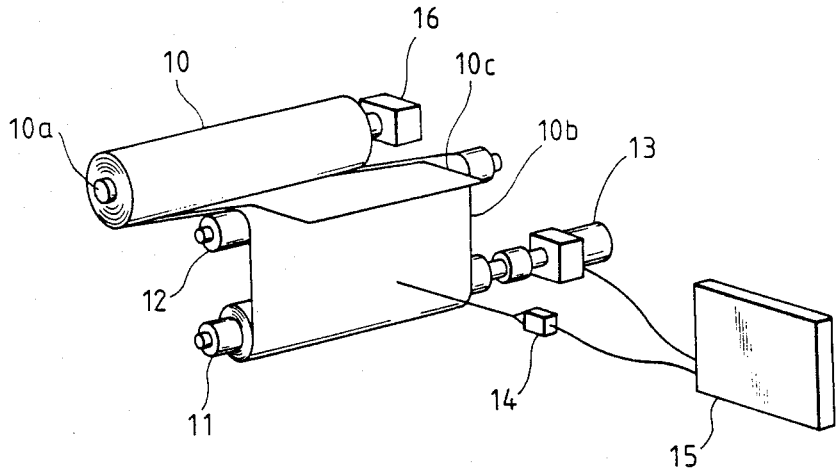
FIG. 1 is a schematic diagram illustrating an embodiment of the present invention.
Figure 2:
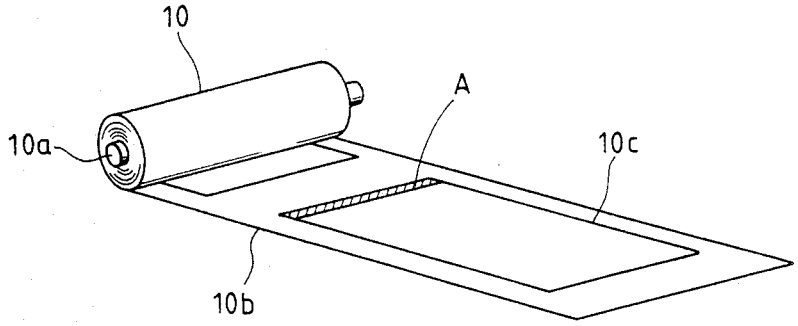
FIG. 2 is a schematic diagram showing a configuration of the stock roll of the present invention.

Turning attention to the Figures wherein like references represent like parts throughout, there is illustrated in FIG. 1 a first embodiment of the present invention. In FIG. 1, a required number of sheet-like photosensitive materials **10*c* each cut to a necessary length are stuck to a release paper 10*b*. Such a release paper 10*b* is wound on a core metal shaft 10*a*, thus constituting a supply roll 10. A takeup roll 11 takes up the release paper 10*b* on the stock roll 10 As more clearly shown in FIG. 3 a positioning roll 12 is determinatively disposed in the vicinity of a drum 1 so that the sheet-like photo-sensitive material is separated from the release paper in that position and fed to a sheet-like photo-sensitive material front end clamp 2 provided on the peripheral surface of the drum 1. A stepping motor 13 imparts a driving force to the take-up roll 16. A speed sensor 14 detects the velocity at which the release paper 10*b* is taken up. Rotational controller 15 controls the rotational frequency of the drive force of the stepping motor 13 in cooperation with the speed sensor 14. A brake 16 provides tension so as not to slacken the release paper 10*b*. As shown in FIG. 2, the sheet-like photo-sensitive material 10*c* is disposed so that its photo-sensitive surface is directed to the release paper 10*b*, and the rear end thereof (a hatching portion indicated by A of FIG. 2) is bonded to the release paper 10b. A adhesive with which the sheet-like photosensitive material 10c is bonded to the release paper 10b has preferably an adhesive power of approximately 200 to 300 gf exhibited in a 90° releasing test but does not remain on the sheet-like photo-sensitive material 10c** after being released therefrom.

Figure 3:
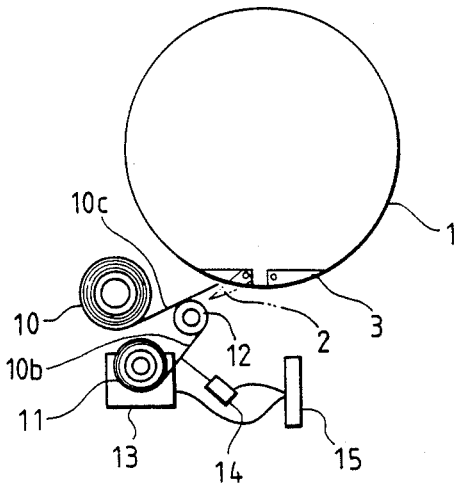
FIG. 3 is a schematic diagram depicting a state wherein a feeder according to the present invention is installed.

In operation, as clearly shown in FIG. 3, after discharging the no longer useable sheet-like photo-sensitive material from the peripheral surface of the drum 1, the drum 1 is stopped in a predetermined position so as to wind an unused photo-sensitive material 10c on its peripheral surface. The front end clamp 2 is opened and clamping preparation is made. Subsequent to this step, the take-up roll 11 is rotated clockwise by means of the stepping motor 13, thereby taking up the release paper 10b. As the release paper 10b is taken up, the sheet-like photo-sensitive material 10c stuck to the release paper 10b is transferred from the supply roll 10 to the positioning roll 12. The direction in which the release paper 10b is transferred is changed from the positioning roll 12 toward the take-up roll 11. However, the unbodied front end of the photo-sensitive material 10c is separated from the release paper 10b at the positioning roll 12 and is then directed to the front end clamp 2, where the front end thereof is to be clamped. After clamping the front end of the photo-sensitive material 10c, the drum 1 is rotated counterclockwise by an drum driving means (not shown), and the sheet-like photo-sensitive material 10c is wound on its peripheral surface. At this time, the controller 15 controls the rotational frequency of the stepping motor 13 so that the take-up velocity of the release paper 10b is equalized to a peripheral speed of the drum 1. Thereafter, the drum 1 is halted in a predetermined position so that the rear end of the photo-sensitive material 10c is clamped by the rear end clamp 3. At this time the rear end of the photo-sensitive material 10c has already been separated from the release paper 10b.

Figure 4:
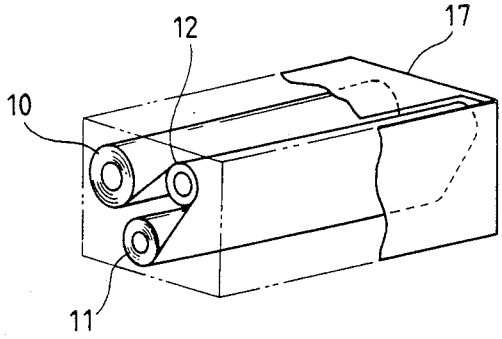
FIG. 4 is a schematic diagram showing an applied example of the present invention.
Figure 5:
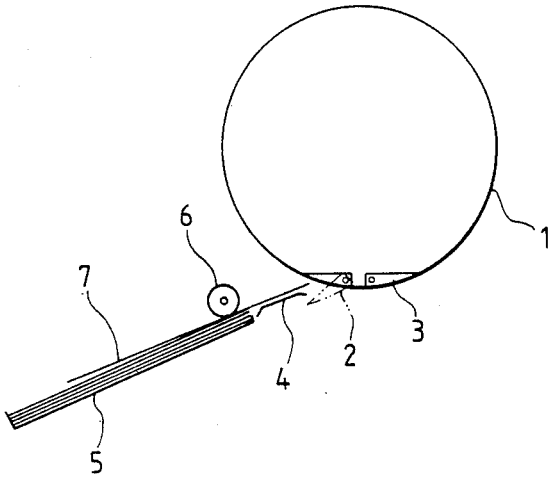
FIG. 5 PRIOR ART
FIG. 5 is a schematic diagram showing a conventional feeder.
Figure 6:
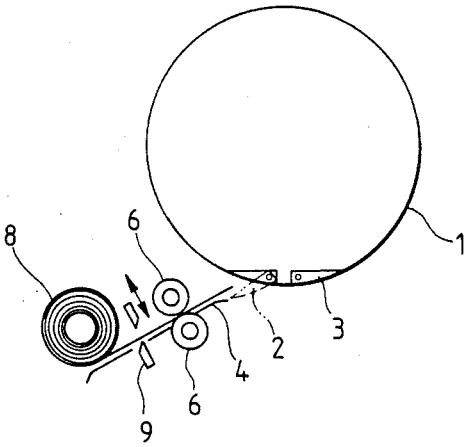
FIG. 6 PRIOR ART
FIG. 6 is a schematic diagram showing another conventional feeder.

As shown in FIG. 4, the supply roll 10, the take-up roll Il and the positioning roll 12 which are employed in the present invention are formed into one united body to provide a cassette. Therefore, the loading of the sheet-like photo-sensitive material may be done for every cassette. This in turn facilitates an easy loading process. As a result, the cost for maintaining the printer can be reduced.

In accordance with the present invention, only the required number of sheets of well-conditioned photo-sensitive materials each cut to the necessary length are stuck to the release paper, and it is feasible to stock up with the rolled release paper. Hence, only the sheets of well-conditioned photo-sensitive materials are fed sheet by sheet onto the drum peripheral surface so that no damage is caused by taking up the release paper with another roll.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

WHAT IS CLAIMED IS:

1. A feeder for a electrophotographic printer for feeding a sheet of photo-sensitive material onto a drum comprising:

a supply of photo-sensitive material;

a supply of release paper bonded to said supply of photo-sensitive material;

means to separate said photo-sensitive material from said release paper;

means to roll said separated photosensitive material onto said drum.

2. A feeder as set forth in claim 1, further comprising:

a stock roll, said release paper having said photo-sensitive material adhered thereto being rolled o said stock roll.

3. A feeder as in claim 2 wherein said supply of photosensitive material comprises a plurality of sheets each having a front end and a rear end.

4. A feeder as in claim 3 wherein said separating means comprises a take-up roll onto which said release paper is rolled after separation from said photo-sensitive material.

5. A feeder as in claim 4 wherein said separating means further comprises a positioning roll disposed between the supply roll and the take-up roll, said positioning roll directing said release paper to said take-up roll and said photo-sensitive material to said drum.

6. A feeder as in claim 5 wherein said means to roll said photosensitive material on the drum comprises a front clamp on said drum to clamp the front end of a photo-sensitive sheet onto the drum and a rear clamp on said drum to clamp the rear end of the photosensitive sheet onto the drum.

7. A feeder as in claim 6 wherein each sheet of photo-sensitive material has a first photo-sensitive surface and a second nonphotosensitive surface.

8. A feeder as in claim 7 wherein the photosensitive material is adhered to the release paper so that said first photo-sensitive surface of each photo-sensitive sheet faces said release paper.

9. A feeder as in claim 8 wherein said separating means further comprises:

a motor for providing a rotational drive force to said take-up roll.

10. A feeder as in claim 9 wherein said motor is a stepping motor.

11. A feeder as in claim 10 wherein said separating means further comprises a rotational speed sensing means for sensing the rotational speed at which the take-up roll rotates.

12. A feeder as in claim 11 wherein said separating means further comprises a rotational controller in communication with said speed sensor, said rotational controller controlling the frequency of drive force of the stepping motor in response to the rotational speed sensed by said speed sensor.

13. A feeder as in claim 12 wherein said feeder further comprises a brake connected to said supply roll to provide tension to said release paper.

14. A feeder as in claim 13 wherein said photo-sensitive sheets are adhered to said release paper by a bonding agent.

15. A feeder as in claim 14 wherein said adhesive has an adhesive power of 200 to 300 gf exhibited in a 90° releasing test.

16. A feeder as in claim 15 wherein said adhesive is adapted so as not to remain on the photo-sensitive sheet after it has been released from said release paper.

17. A feeder as in claim 16 wherein said photo-sensitive sheets are adhered to said release paper at the rear end thereof.

18. A feeder as in claim 17 wherein said stock roll, said take-up roll and said positioning roll are disposed within a cassette.

19. A method of feeding a photosensitive material onto the drum of a photoprinter comprising the steps of:

separating the photo-sensitive material from release paper; and rolling said photo-sensitive material onto the drum.

20. A method as in claim 19 wherein said separating step comprises the steps of:

rotating a supply roll on which said photo-sensitive material and said release paper are disposed in a counterclockwise direction thereby passing said release paper and said photosensitive material over a positioning roll; and rotating a take-up roll in a clockwise direction so that said release paper is rolled onto said take-up roll.

21. A method as in claim 20 wherein said step of rolling said photo-sensitive material onto said drum step includes the steps of:

clamping a front end of the photosensitive material onto the drum;

rotating the drum; and clamping the rear end of the photosensitive sheet onto the drum.

22. A method as in claim 21 wherein said take-up roll is rotated in a stepping mode.

23. A method as in claim 22 further comprising the step of controlling the rotational frequency of the take-up roll so that the velocity of the release paper is equal to the rotational speed of the drum.

* * * * *